US010345071B2

(12) United States Patent
LaBreche

(10) Patent No.: US 10,345,071 B2
(45) Date of Patent: Jul. 9, 2019

(54) PROTECTIVE COVER FOR HUNTING ARROW HEADS STORED IN AN ARCHERY QUIVER

(71) Applicant: Terry LaBreche, Missoula, MT (US)

(72) Inventor: Terry LaBreche, Missoula, MT (US)

( * ) Notice: Subject to any disclaimer, the term of this patent is extended or adjusted under 35 U.S.C. 154(b) by 0 days.

(21) Appl. No.: 15/262,948

(22) Filed: Sep. 12, 2016

(65) Prior Publication Data

US 2019/0137211 A1 May 9, 2019

(51) Int. Cl.
*F41B 5/06* (2006.01)

(52) U.S. Cl.
CPC ..... *F41B 5/066* (2013.01)

(58) Field of Classification Search
CPC ..... F41B 5/06; F41B 5/066; Y10S 224/916
USPC ..... 124/25.5, 25.7, 41.1, 44.5, 86, 88; 224/916
See application file for complete search history.

(56) References Cited

U.S. PATENT DOCUMENTS 2,566,786 A * 9/1951 Zaccard ..... F41B 5/063 124/25.7
2,872,959 A * 2/1959 Stockfleth ..... F41B 5/063 124/25.7
2,905,218 A * 9/1959 Smith ..... F41B 5/063 124/25.7
3,010,502 A * 11/1961 Sundquist ..... F41B 5/063 206/315.11
3,337,099 A * 8/1967 Rose ..... F41B 5/063 224/242
3,465,928 A * 9/1969 Osterholm ..... F41B 5/063 124/25.7
3,561,651 A * 2/1971 Ramsey ..... F41B 5/066 124/25.5
3,591,062 A * 7/1971 Karbo ..... F41B 5/066 124/25.7
4,073,328 A * 2/1978 Franklin ..... F41B 5/063 124/25.7
4,156,496 A * 5/1979 Stinson ..... F41B 5/066 124/25.7
4,247,027 A * 1/1981 Tardiff ..... F41B 5/066 124/25.7
4,387,805 A * 6/1983 Lanius ..... F41B 5/14 206/230
4,788,961 A * 12/1988 Toth ..... F41B 5/066 124/25.5
4,805,584 A * 2/1989 Stinson ..... F41B 5/066 124/25.5
4,995,372 A * 2/1991 Topel ..... F41B 5/066 124/25.5

(Continued)

*Primary Examiner* — Alexander R Niconovich

(57) ABSTRACT

A protective cover for hunting arrow heads stored in an archery quiver, the protective cover having an outer case and an inner unit, the outer case being hollow with a solid top, four solid sides, and an open bottom, and the inner unit having a rigid base and a plurality of cylindrically-shaped, flexible filaments. The base has a planar bottom surface, the top end of each of the filaments is connected to the bottom surface of the base. Each filament extends perpendicularly downward from the bottom surface of the base when arrow heads are not inserted into the protective cover, and each filament is configured to flex away from its perpendicular orientation when an arrow head is inserted into the protective cover and exerts lateral force on the filament.

8 Claims, 2 Drawing Sheets

(56) References Cited

U.S. PATENT DOCUMENTS 5,452,703 A * 9/1995 Bateman, III ..... F41B 5/066 124/25.7
6,006,734 A * 12/1999 Sodaro ..... F41B 5/066 124/25.5
6,390,085 B1 * 5/2002 Stinson ..... F41B 5/066 124/25.7
6,431,162 B1 * 8/2002 Mizek ..... F41B 5/066 124/25.5
6,672,299 B2 1/2004 Proctor
6,691,694 B2 * 2/2004 Stinson ..... F41B 5/066 124/25.5
7,987,842 B2 8/2011 McPherson
8,061,341 B2 11/2011 Hudkins
8,499,754 B2 * 8/2013 Vergin ..... F41B 5/066 124/1
8,596,256 B2 12/2013 McPherson
8,714,147 B2 * 5/2014 Walk ..... F41B 5/066 124/86
8,899,221 B2 * 12/2014 Barnett ..... F41B 5/066 124/86
8,931,469 B2 * 1/2015 Kingsbury ..... F41B 5/066 124/88
9,163,895 B2 * 10/2015 Pedersen ..... F41B 5/066
9,372,045 B1 * 6/2016 Kempf ..... F41B 5/06
9,651,330 B1 * 5/2017 LoRocco ..... F41B 5/066
9,766,031 B2 * 9/2017 Evans ..... F41B 5/066
2002/0062826 A1 * 5/2002 Proctor ..... F41B 5/066 124/86
2006/0112945 A1 * 6/2006 Rager ..... F41B 5/066 124/86
2008/0251059 A1 * 10/2008 McPherson ..... F41B 5/066 124/44.5
2008/0302346 A1 * 12/2008 Notestine ..... F41B 5/066 124/25.7
2010/0300421 A1 * 12/2010 LoRocco ..... F41B 5/066 124/86
2011/0030668 A1 * 2/2011 Hudkins ..... F41B 5/066 124/86
2011/0174284 A1 * 7/2011 Hunt ..... F41B 5/066 124/44.6
2011/0283982 A1 11/2011 McPherson
2014/0083405 A1 3/2014 McPherson

* cited by examiner

FIGURE 1
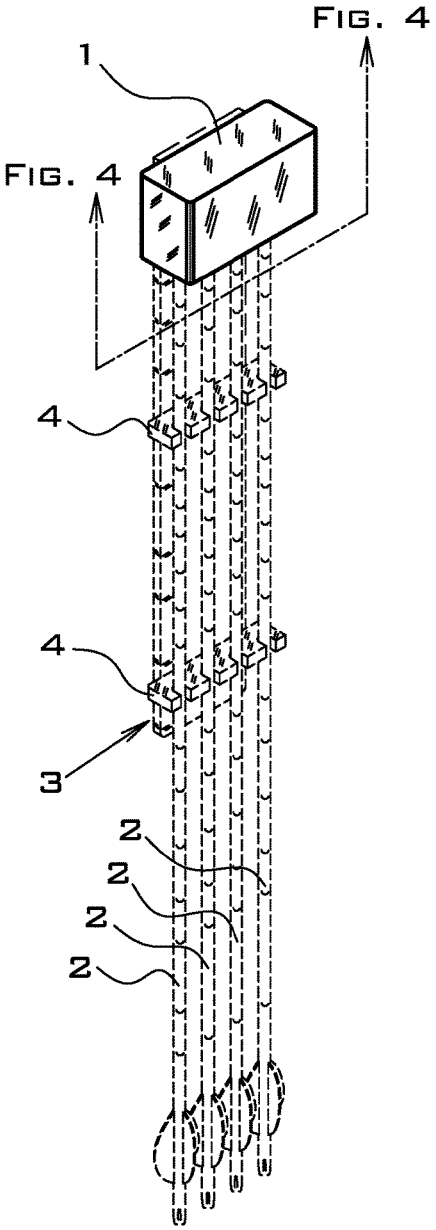
FIGURE 2
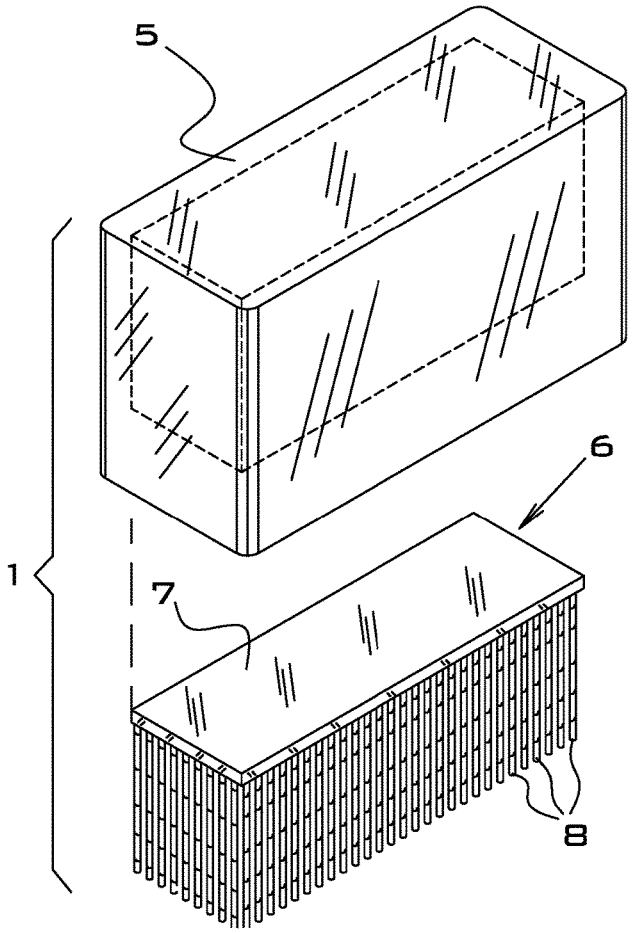
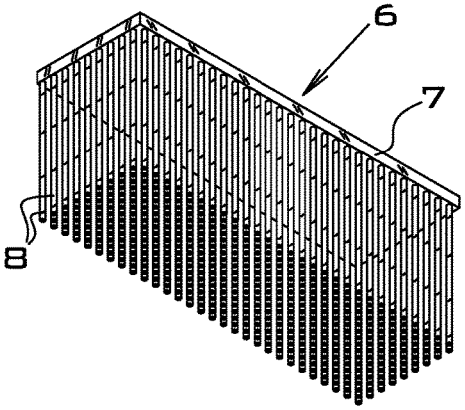
FIGURE 3

PROTECTIVE COVER FOR HUNTING ARROW HEADS STORED IN AN ARCHERY QUIVER

BACKGROUND OF THE INVENTION

1. Field of the Invention

The present invention relates to the field of archery quivers, and more particularly, to the protective components of bow-mounted archery quivers that shield the sharp blades of hunting arrows that are stored in the quivers.

2. Description of the Related Art

There are numerous examples in the prior art of various types of protective arrow head covers that are components of bow-mounted arrow quivers, but none of these examples is similar structurally to the present invention or provides the advantages of the present invention, which eliminates dulling of the arrow blades and the production of undesirable noises and excess friction when arrows are inserted or withdrawn from the quiver.

U.S. Pat. No. 3,561,651 (Ramsey, 1971) discloses a quiver that is removably attachable to a bow without tools and that comprises a metal or plastic guard that covers the head portion of arrows being carried in the quiver. The invention may be mounted onto a bow so as to be usable by either a right-handed or a left-handed archer. The invention comprises an upper horizontal plate and a lower horizontal plate, both of which are manufactured from "rubber material, natural, synthetic, or of other plastic" [col. 3, line 74]. The points of the arrow heads partially penetrate into holes ("transversely extending arrowhead receiving openings") [col. 3, lines 26-27] that are manufactured into the upper horizontal plate, so that a portion of the sharp cutting edges of the arrow heads are in contact with the outer surfaces of the holes. The shafts of the arrows are held within slotted holes that are manufactured into the lower horizontal plate. The invention further comprises an arrow head shield or cap guard made of plastic material that fits over and around the sharp cutting edges of the arrow heads. In one embodiment, the cap guard incorporates "an elongated block of sponge rubber 210" [col. 6, line 5] in which the "arrowheads 96a are caused to releasably penetrate within the sponge rubber block 210 in the manner shown in FIG. 7" [col. 6, lines 60-61]. From the text descriptions and drawings of this invention, it appears that a portion of the sharp blades of the arrow heads are in contact with either hard plastic or sponge rubber in each of the embodiments.

U.S. Pat. No. 3,591,062 (Karbo, 1971) discloses a bow-mounted quiver that is adjustable in length. With this invention, arrows are secured by an arrow clip at the lower end and a cup-shaped hood at the upper end. The arrow clip is manufactured from flexible material such as rubber or flexible plastic and comprises a plurality of slots into which the shafts of the arrows are secured. The hood comprises a plurality of arrow receiving slots that appear to be arrowhead shaped [FIG. 2, reference number 21]. The heads of the arrows fit into the slots and are thereby held in a "spaced relationship" [col. 2, line 33]. There is no description of the materials comprising the hood. From FIG. 2, it appears that the sharp blades of the arrow heads are not prevented from contacting the edges of the receiving slots.

U.S. Pat. No. 4,073,328 (Franklin, 1978) discloses a quiver designed to be worn on the back of an archer. This invention comprises two bridges manufactured from resilient material, each bridge comprising a plurality of slots designed to fit around and secure a plurality of arrow shafts. Arrows are carried with the arrow heads pointed upward, and the arrow heads are protected by a cup-shaped cap that fits around the arrow heads. The cap comprises an internal abutment that is covered with a "resilient pad made of rubber or some other suitable material" [col. 3, lines 10-11], and the points of the arrow heads are pressed against this resilient material in order to secure the arrow heads in position and protect the points of the arrow heads. In one embodiment, the slots of the two bridges are manufactured in a specialized "frustoconical configuration" [col. 2, line 39] that enables an arrow to easily be slid upward through a slot but requires significantly more force to be slid downward through the slot. This feature allows the arrows to be easily installed into the quiver with the arrow heads pushed against the abutment and then holds the arrows in position.

U.S. Pat. No. 6,006,734 (Sodaro, 1999) discloses a quick-release, bow-mounted quiver designed to simultaneously carry a first quantity of arrows along the left side of a bow and a second quantity of arrows along the right side of the bow. At the lower end, the invention comprises a molded or machined elastomer arrow shaft holder with a plurality of slots to hold a plurality of arrow shafts. At the upper end, the invention comprises a protective arrow hood manufactured from plastic, metal, composite or laminate materials with two identical sections, one positioned on each side of the bow. Each section is hollow and open on the lower side only. Each section is filled with a replaceable foam rubber insert, and each insert contains conical recesses to receive arrow heads ("Hood sections 210 and 220 are substantially filled with replaceable foam rubber inserts 285 and 290 for holding arrow heads 30 pressed into the foam rubber" [col. 4, lines 58-60]). Arrows are secured into the quiver by inserting the shafts of the arrows into the slots of the arrow shaft holder and pushing the points of the arrow heads into the conical recesses of the foam rubber inserts of the hood.

U.S. Pat. No. 6,672,299 (Proctor, 2004) discloses a quick-detachable quiver adapted for mounting on a bow, hip belt, tree stand or other suitable structure and providing a vibration-damping mount assembly. The invention comprises one or two arrow holders with slots that fit around the shafts of arrows and a protective hood that "may be formed by injection molding various plastics or other suitable material" [col. 8, lines 12-13]. The hood fits over the heads of arrows secured in the quiver and is filled with one or more removable foam layers "to bury broad head, or other type, arrow tips (not illustrated)" [col. 8, lines 21-22]. One of the foam layers may be removed to accommodate various types of arrow tips "including points, single blade, multi-blade, or mechanically active . . . " [col. 8, lines 25-26].

U.S. Pat. No. 7,987,842 (McPherson, 2011), U.S. Pat. No. 8,596,256 (McPherson, 2013) and U.S. Pat. No. 9,400,154 (McPherson, 2016) disclose a quiver that may be releasably attached to a bow, tree, tree stand, or other structure. The quiver comprises an arrow gripper than contains a plurality of slots into which arrows are secured and a protective hood that fits around the tips of the arrows. The hood is comprised of "an arrow retaining insert 32, preferably composed of a foam material, with arrowhead slots 100 formed therein" [col. 4, lines 35-36]. The arrowhead slots are generally star-shaped with a generally round center section. The arrowhead slots are specifically shaped so as to interchangeably fit a variety of arrow point types, including single point (target tips), and two-, three- or four-bladed broadhead tips.

U.S. Pat. No. 8,061,341 (Hudkins, 2011) discloses a quick-detachable, bow-mounted quiver that incorporates a tree screw and a bow hook. By use of the tree screw, the quiver may be detached from the bow and attached to a tree while the archer is hunting. By use of the bow hook, the bow may also be attached to the tree, thereby freeing the hands of the archer while waiting for game. The quiver comprises an elastomeric arrow shaft holder and a protective hood. The hood may comprise a "resilient elastomeric or foam insert block that may be used to firmly hold the broadheads" [col. 3, lines 30-31]. No further details of the hood are disclosed.

U.S. Pat. No. 9,400,153 (Evans, 2016) discloses a combined bow stabilizer/arrow quiver in which arrows may be stored alongside and parallel to a stabilizer shaft, so that the mass of the arrows increases the stabilizing function of the stabilizer assembly. The invention comprises a protective hood, which contains a broadhead hood insert. The insert is comprised of "foam rubber, rubber, polyethylene, or other material commonly used in the art" [col. 9, lines 17-18]. The insert material may be punctured by the broadhead and then compressed around the broadhead; alternately, cuts may be made in the insert material to receive and secure the broadhead. The insert may incorporate a screw or other adjustment feature that provides compression of the insert around the broadhead or locking mechanisms that snap into notches or other features of the broadhead.

U.S. Patent Application Pub. No. 2008/0302346 (Notestine) discloses a bow-mounted quiver with a mounting member that is quick-detachable and rotatable. The quiver comprises an arrow gripper with slots that removably receive arrow shafts [0037] and a protective hood that fits around the tips of arrows. The hood comprises a foam insert that "engages the tips of arrows" [0023]. The quiver is designed to accept mechanical or fixed broadheads. The foam is optionally comprised of two layers, with one layer being removable so as to allow the hood to "adjust for different size arrow tips"

No additional details of the hood are disclosed.

BRIEF SUMMARY OF THE INVENTION

The present invention is a protective cover for hunting arrow heads stored in an archery quiver, the protective cover comprising an outer case and an inner unit, the outer case being hollow and comprised of a solid top, four solid sides, and an open bottom, the inner unit comprised of a rigid base and a plurality of cylindrically-shaped, flexible filaments; wherein the base has a planar bottom surface, each of the plurality of flexible filaments has a top end, and the top end of each of the filaments is connected to the bottom surface of the base; and wherein each filament extends perpendicularly downward from the bottom surface of the base when arrow heads are not inserted into the protective cover, and each filament is configured to flex away from its perpendicular orientation when an arrow head is inserted into the protective cover and exerts lateral force on the filament.

In a preferred embodiment, each of the filaments has a diameter and a length, the diameters of the filaments are substantially identical, and the lengths of the filaments are substantially identical. Preferably, each of the filaments has a modulus of elasticity in the range of about ($5\times10^8$) to ($5\times10^9$) Newtons per square meter ($N/m^2$), and each of the filaments has a minimum yield strength of about ($1\times10^7$) $N/m^2$. The filaments are preferably arranged in staggered rows and columns, and each row of filaments is laterally offset from an adjacent row.

The present invention also encompasses an archery quiver comprising the protective cover as described above.

BRIEF DESCRIPTION OF THE DRAWINGS

FIG. 1 is an isometric view of the present invention installed on a generic arrow quiver.

FIG. 2 is an exploded isometric view of the present invention showing the top and two sides of the outer case and the inner unit.

FIG. 3 is an isometric view of the inner unit showing the lower surface.

REFERENCE NUMBERS

Figure 4:
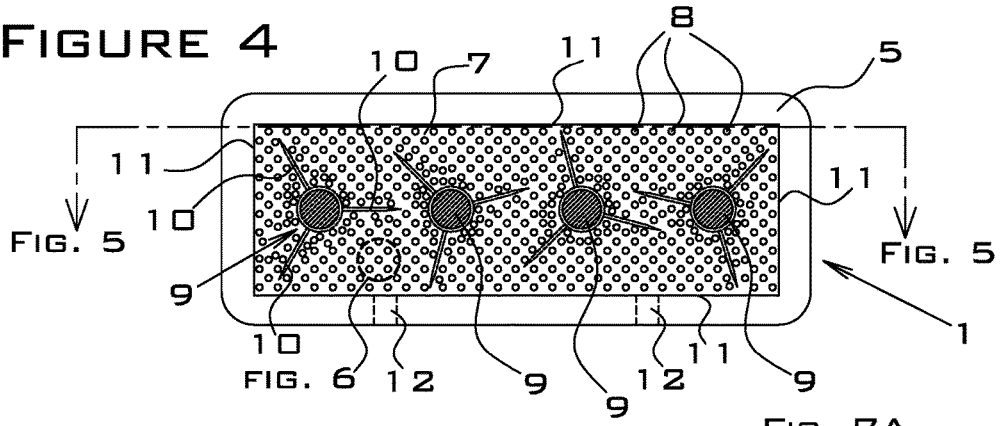
FIG. 4 is a cross-section bottom view of the present invention taken at the section line shown in FIG. 1 and loaded with four arrows.

1 Protective cover
2 Arrow
3 Quiver
4 Arrow clips
5 Outer case
6 Inner unit
7 Base

DETAILED DESCRIPTION OF INVENTION

The present invention is a protective device (and, alternately, a quiver incorporating the protective device described and illustrated herein) that separates and covers the heads of hunting arrows that are placed within a bow-mounted quiver for storage. The present invention comprises an array of flexible polymer fibers or filaments that fit alongside and around the sharp blades of broadhead arrow heads, thereby supporting the arrow heads and securing them into fixed positions without requiring the sharp edges of the blades to be in direct contact with the supporting filaments. This unique structure eliminates some major disadvantages of the prior art caused by the plastic or foam plastic arrow head support materials of the prior art, in particular, dulling of the arrow blades, destructive cutting of the arrow head support materials by the arrow blades, and undesirable noise and excessive friction when removing the arrow heads from the protective covers. The present invention is suitable for use with both fixed-blade and moveable blade broadhead arrows with arrow heads having any number of blades.

FIG. 1 is an isometric view of the present invention installed on a generic arrow quiver. As shown, the present invention is a protective cover 1 that protects the heads of a plurality of arrows 2 that are secured onto a quiver 3 with arrow clips 4. The quiver 3 may be any one of a plurality of commercially available quivers, in which the original protective arrow head cover has been removed and replaced by the protective cover 1 of the present invention, or it may be a quiver in which the protective cover 1 of the present invention has been installed as original equipment during manufacture of the quiver. The arrow clips 4 grip the shafts of the arrows 2 and hold the arrows in fixed positions. The arrow clips 4 (discussed further in relation to FIG. 4) are common to most commercially available quivers and are made in a variety of configurations.

Figures 7A, 7B:
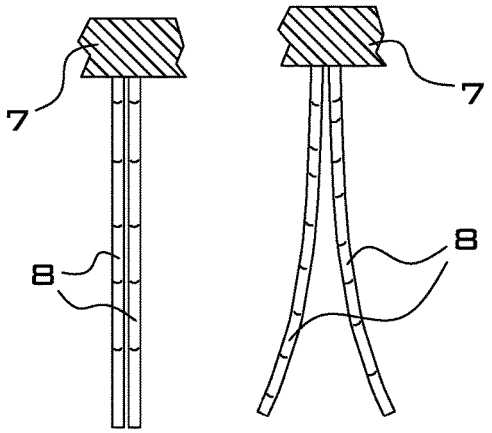
FIG. 7A is a magnified cross-section view of the detail area shown in FIG. 5, illustrating two adjacent filaments that are oriented perpendicularly to the lower surface of the base, in an undeflected position.
FIG. 7B shows the same view of the two adjacent filaments shown in FIG. 7A, but with the filaments deflected by the insertion of an arrow head.

FIG. 2 is an exploded isometric view of the present invention showing the top and two sides. Although the embodiment shown is generally in the shape of a rectangular parallelepiped (i.e., rectangular in horizontal and vertical cross sections), other shapes such as round, oval, or non-geometric (irregular) in horizontal cross section are permissible. As shown, the protective cover 1 comprises an outer case 5 and an inner unit 6. The outer case 5 is hollow and is comprised of a solid top, four solid sides, and an open bottom. The inner unit 6 comprises a rigid base 7 and a plurality of flexible filaments 8. The base 7 has a planar (flat) bottom surface. The top end of each of the filaments 8 is connected to the bottom surface of the base 7, and each individual filament 8 is cylindrically shaped. The filaments 8 may be connected to the base 7 by inserting the filaments 8 into holes that are formed (for example, by machining or molding) into the base 7 and then securing the filaments to the base by a friction fit of the filaments 8 within the holes, optionally augmented by heat welding or by gluing. Alternately, the filaments 8 may be heat welded or glued to the flat lower surface of the base 7 without inserting the filaments 8 into holes within the base, or the base 7 and filaments 8 may be manufactured as a single molded unit. The diameters of the filaments 8 are substantially identical, and the length of the filaments 8 are also substantially identical. The filaments are arranged in rows and columns, as described in more detail in reference to FIG. 6. Each filament 8 extends perpendicularly downward (as shown in FIGS. 2 and 3) from the bottom surface of the base 7 when arrow heads are not inserted into the protective cover 1, but any of the filaments 8 may flex away from its perpendicular orientation when an arrow head is inserted into the present invention and exerts lateral force on the filament (as shown in FIG. 7B).

The outer case 5 and the inner unit 6 are preferably comprised of thermoplastic polymeric material such as polypropylene, polyester, polyethylene, or nylon, and they are preferably manufactured by injection molding. The outer case 5 and the inner unit 6 may be manufactured as separate pieces that are assembled after manufacture, or alternately, they may be manufactured as a single injection-molded part. The outer case 5 is manufactured so as to be watertight on the top and sides, thereby minimizing exposure of arrow heads to rain, snow and dirt particles. The filaments 8 may be made from the same thermoplastic polymeric material as the base 7, or they may be made from a different polymeric material if the filaments 7 and base 8 are manufactured as separate parts. In order for the filaments 8 to have suitable flexibility and adequate strength, the filaments 8 preferably have a modulus of elasticity in the range of about ($5\times10^8$) to ($5\times10^9$) Newtons per square meter ($N/m^2$) and a minimum yield strength of about ($1\times10^7$) $N/m^2$. FIG. 3 is an isometric view of the inner unit 6 showing the lower surface. As shown, the upper end of each of the filaments 8 is attached to the lower surface of the base 7, and the lower end of each filament 8 is unattached to other objects.

FIG. 4 is a cross-section bottom view of the present invention taken at the section line shown in FIG. 1 and loaded with four arrows, illustrating the positioning of four arrow heads 9 that have been inserted into the protective cover 1, wherein each arrow head 9 comprises three sharp blades 10. The arrow heads 9 are inserted into the protective cover 1 by individually pushing each arrow 2 (shown in FIG. 5) vertically upward so that the arrow head 9 is forced between a portion of the filaments 8 of the protective cover 1. The arrows 2 are restrained in position by the arrow clips 4 (shown in FIG. 1), which are comprised of elastomeric material and contain slots that form friction fits around the shaft of each arrow 2.

As illustrated in FIG. 4, when an arrow head 9 has been inserted into protective cover 1, the sharp blades 10 of the arrow head 9 do not rub directly against any of the filaments 8 because flexing of the filaments 8 causes them to deflect away from the sharp edges of the blades 10 when an arrow head is inserted into the array of filaments 8. This is an important distinction between the present invention and examples of the prior art that use plastic or foam plastic to contact or surround the arrow heads because in the prior art, the sharp blades of the arrow heads are in placed in direct contact with the plastic or foam plastic material, resulting in eventual cutting of the material and dulling of the blades. Conversely, with the present invention, the filaments 8 are not damaged, and the blades 10 of the arrow heads 9 are not dulled when the arrow heads 9 are inserted into the protective cover 1. In a preferred embodiment of the present invention, the material composition, filament dimensions and filament spacing are selected to as to produce filaments having a flexibility that results in a force requirement of about 6 to 16 ounces to fully insert (by pushing on the arrow shaft) a broadhead arrow head into the array of filaments.

FIG. 4 also illustrates that the rotational orientation of the arrow heads 9 is not critical, as long as the blades 10 of each arrow head 9 are separated from the blades 10 of adjacent arrow heads 9 and also separated from the internal walls 11 of the outer case 5. This non-critical orientation feature is an advantage over the prior art of U.S. Pat. No. 7,987,842 and similar patents wherein the arrow heads must be precisely oriented so that the blades fit into precut slots within the foam material. The latter devices require more time and precision to install a set of arrows into a quiver than are required for the present invention, which requires less precise arrow head orientation.

Also shown in FIG. 4 are a pair of optional mounting holes 12 that may be used to attach the protective cover 1 to a quiver. The mounting holes 12 may be machined or molded into the outer case 5 during manufacture; alternately, the mounting holes 12 may be drilled into the outer case 5 after manufacture so as to match corresponding holes that are installed into a particular model of quiver. The protective cover 1 may be attached to a quiver by installing pins, bolts or screws through the mounting holes 12 and into corresponding mounting holes in the quiver (not shown).

Figure 5:
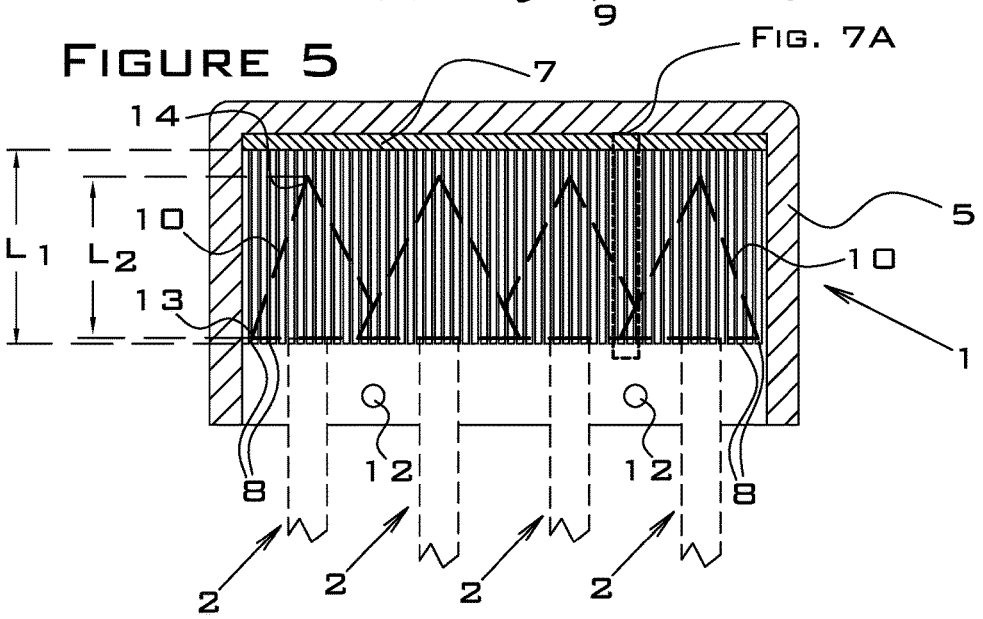
FIG. 5 is a cross-section side view of the present invention loaded with four arrows, with the section line taken as shown in FIG. 4.

FIG. 5 is a cross-section side view of the present invention 1 loaded with four arrows 2, with the section line taken as shown in FIG. 4. As shown, correct insertion of an arrow head into the protective cover 1 is achieved when the rear edge 13 of the blade (the portion of the blade adjacent to the arrow shaft) is inserted to just above the lower end of the filaments 8, thereby completely embedding the rear edge 13 of the blade 10 within the array of filaments 8. Note that the tip 14 of the blade 10 does not contact the base 7 when the arrow 2 is correctly installed because the length L1 of the filaments 8 is selected so as to be greater than the length L2 of the blades 10. The protective cover 1 may be manufactured in various sizes to accommodate various sizes and types of arrow heads, as described in more detail in reference to FIG. 6. As shown, the mounting holes 12 are preferably positioned below the lower edges of the filaments 8 to facilitate mounting and removing the protective cover 1 to and from a quiver.

Figure 6:
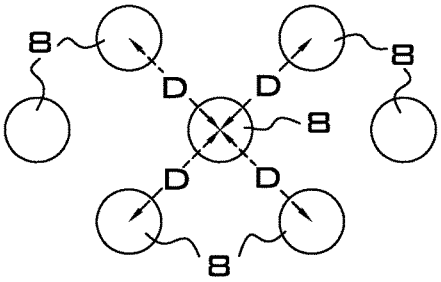
FIG. 6 is a magnified bottom view of a segment of the array of filaments taken at the detail area shown in FIG. 4.

FIG. 6 is a magnified bottom view of a segment of the array of filaments 8 taken at the detail area shown in FIG. 4. As shown, in the preferred embodiment, the filaments 8 are positioned in staggered rows and columns, wherein each row of filaments is laterally offset from its two adjacent rows as shown in FIG. 6; however, other orientations, such as aligned rows and columns, wherein the filaments in each row are in vertical alignment with the filaments in adjacent rows, are permissible. Also as shown, the axis of each filament 8 is separated from the axes of the closest surrounding filaments 8 by distance D. In a preferred embodiment of the present invention that is suitable for containing four arrow heads with each arrow head having a length of 1¼-inch and a maximum blade diameter of 1¼ inch, the outer case 5 has a length of 4½ inches, a width of 1⅞ inches, a height of 2½ inches, and a wall thickness of the top and sides of ¼ inch; and each filament 8 has a length of 1½ inch, a diameter of 1/20 inch, and an inter-axial separation distance (D in FIG. 6) of 1/10 inch. In this preferred embodiment, the ratio of the filament diameter to the inter-axial separation distance of the filaments is 0.5 [(1/20 inch)/1/10 inch)]. In other embodiments, the outer case may have a length ranging from about 2 to 8 inches, a width ranging from about 1 to 4 inches, a height ranging from about 1 to 4 inches, and a wall thickness of the top and sides ranging from about ⅛ to ½ inch; and the filaments may have a length ranging from about ½ to 3 ½ inches, a diameter ranging from about 1/50 to ⅛ inch, an inter-axial separation distance of about 1/25 to ¼ inch, and a ratio of the filament diameter to the inter-axial separation distance of the filaments ranging from about 0.25 to 1.0.

FIGS. 7A and 7B are detail cross-section side views taken at the location shown in FIG. 5 that illustrate the positions and shapes of typical filaments 8. FIG. 7A shows two adjacent filaments 8 that are oriented perpendicularly to the lower surface of the base 7. This is the orientation that occurs when an arrow head is not causing the filaments to deflect from, their normal undeflected positions.

FIG. 7B shows the same view of the two adjacent filaments shown in FIG. 7A, but with the filaments deflected by the insertion of an arrow head, as would occur when the blade of an arrow head (not shown) is pushed between the two filaments. (The magnitude of deflection of the filaments has been exaggerated for clarity in this figure). Due to the elastic properties of the material comprising the filaments 8, the filaments 8 will spring back to their original undisturbed positions (shown in FIG. 7A) when the arrow head is removed.

Although the present invention is described in conjunction with bow-mounted archery quivers, the present invention is also suitable for use in conjunction with other types of quivers, such as tree-stand mounted quivers and over-the-shoulder quivers. Furthermore, although the present invention is described in conjunction with quivers that carry arrows in a vertical position with the arrow heads pointed upward, the present invention is equally suitable for use in conjunction with quivers that carry arrows in any orientation.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A protective cover for hunting arrow heads stored in an archery quiver, the protective cover comprising an outer case and an inner unit, the outer case being hollow and comprised of a solid top, four solid sides, and an open bottom, the inner unit comprised of a rigid base and a plurality of cylindrically-shaped, flexible filaments;

wherein the outer case is manufactured so as to be watertight on the top and sides;

wherein the base has a planar bottom surface, each of the plurality of flexible filaments has a top end, and the top end of each of the filaments is connected to the bottom surface of the base;

wherein each filament extends perpendicularly downward from the bottom surface of the base when arrow heads are not inserted into the protective cover, and each filament is configured to flex away from its perpendicular orientation when an arrow head is inserted into the protective cover and exerts lateral force on the filament;

wherein material composition, filament dimensions and filament spacing are configured to produce filaments having a flexibility that results in a force requirement of about six to 16 ounces to fully insert a broadhead arrow head into the plurality of filaments; and wherein each arrow head comprises a blade with a rear edge;

wherein the filaments are configured within the protective cover so that when an arrow head is inserted into the protective cover, the rear edge of the blade is positioned above a lower end of the filaments, thereby completely embedding the rear edge of the blade within the plurality of filaments; and wherein each blade comprises a tip;

wherein each blade has a length;

wherein each filament has a length, and all of the filaments have the same length;

wherein the plurality of filaments within the protective cover are configured so that the tip of the blade does not contact the base when an arrow is installed within the protective cover; and wherein the length of the filaments is greater than the length of the blades.

2. The protective cover of claim 1, wherein each of the filaments has a diameter and a length, the diameters of the filaments are substantially identical, and the lengths of the filaments are substantially identical.

3. The protective cover of claim 1, wherein each of the filaments has a modulus of elasticity in a range of about ($5\times10^8$) to ($5\times10^9$) Newtons per square meter ($N/m^2$).

4. The protective cover of claim 1, wherein each of the filaments has a minimum yield strength of about ($1\times10^7$) $N/m^2$.

5. The protective cover of claim 1, wherein the filaments are arranged in staggered rows and columns, and wherein each row of filaments is laterally offset from an adjacent row.

6. An archery quiver comprising the protective cover of any of claims 1-5.

7. The protective cover of claim 1, wherein the outer case further comprises a pair of mounting holes that are configured to attach the protective cover to a quiver;

wherein each filament has a lower edge; and wherein the mounting holes are positioned below the lower ends of the filaments.

8. The protective cover of claim 1, wherein each filament has a diameter and an axis that is separated from the axes of adjacent surrounding filaments by an inter-axial distance;

wherein there is a ratio of the filament diameter to the inter-axial separation distance of the filaments; and wherein the ratio of filament diameter to inter-axial separation distance of the filaments is in the range of 0.25 to 1.0 inch.

* * * * *